United States Patent [19]

Martin

[11] Patent Number: 4,480,768

[45] Date of Patent: Nov. 6, 1984

[54] HAND-OPERATED PUMP

[75] Inventor: Douglas S. Martin, Lawrenceville, Ga.

[73] Assignee: Universal Dispensing Systems, Inc., Atlanta, Ga.

[21] Appl. No.: 423,623

[22] Filed: Sep. 27, 1982

Related U.S. Application Data

[63] Continuation-in-part of Ser. No. 395,685, Jul. 6, 1982.

[51] Int. Cl.[3] ..... B65D 47/34

[52] U.S. Cl. ..... 222/341; 222/383

[58] Field of Search ..... 222/341, 384, 385, 340, 222/383, 209; 239/333

[56] References Cited

U.S. PATENT DOCUMENTS

| | | | |
|---|---|---|---|
| 4,072,252 | 2/1978 | Steyns et al. | 222/341 |
| 4,161,288 | 7/1979 | McKinney | 222/385 X |
| 4,310,104 | 1/1982 | Takasuki | 222/209 |

OTHER PUBLICATIONS

Fluid Dispenser Photos No. 1 and 2, 1977.

*Primary Examiner*—Stanley H. Tollberg

*Attorney, Agent, or Firm*—Barnes & Thornburg

[57] ABSTRACT

A hand-operated pump for dispensing a fluid from a container includes a body containing a pumping chamber having an inlet and an outlet conduit. A piston is reciprocably mounted in the pumping chamber, the piston having a convexly contoured outer end surface. A trigger pivotally mounted and locked to the body has a plurality of triangular supports co-joined to form a tapered socket receiving the outer end surface of the piston. A channel-defining insert is received in the outlet conduit, the insert having a centrally situated, forwardly facing, fixed protuberance. An elastic, cup-shaped member secured at its periphery to the body has a central aperture situated in contact with and closed by the fixed protuberance. The central aperture of the cup-shaped member is a cavity in the center of the interior surface of the member extending only partway through the member, at least two depressions on the exterior surface of the member spaced from each other yet each intersecting the cavity, and a swirl chamber situated between and connected to the depressions. The top of the pump is mechanically secured to the outside of the outlet conduit by tabs straddling and locking to the conduit.

6 Claims, 9 Drawing Figures

HAND-OPERATED PUMP

This application is a continuation-in-part of my earlier application Ser. No. 395,685, filed July 6, 1982.

The present invention is directed generally to hand-operated pumps for dispensing fluids as a spray or stream. The invention is more particularly directed to hand-operated pumps having a body within which is situated a movable solid surface which acts to propel the fluid through a variably acting outlet. The invention is further directed to such hand-operated pumps as are separately secureable to a holder of a supply of the fluid to be dispensed in such a manner as to seal the fluid within the holder and pump.

A variety of simple and inexpensive hand-operated pumps for use as dispensers of liquid have been developed which include means for engaging containers from which a liquid is to be dispensed under pressure generated by the pumping mechanism. A wide variety of designs of such pumps have evolved having common operational goals of servicability and durability at minimum cost. Typically, such pumps are not sold as a separate item to the ultimate consumer, but, rather, are included as a dispensing feature on a container filled with a particular liquid, the functional attributes of the liquid representing the major marketing aspect of the product as a whole.

Various improvements have been attempted so as to accommodate standard containers of liquids in a manner as to preclude leakage or other possible accidental displacement from the container, particularly prior to the initial sale to the ultimate consumer. Usually, such dispensers include a trigger member, plunger, or other protruding element which is intended to be moved manually to operate a pump piston with a body, usually against the force of a return spring, so that liquid may be pumped from the container and dispensed through an ejection nozzle or outlet. Preferably, the ejecting nozzle is one which may be varied so as to eject the liquid in the form of a stream or spray. The nozzle structure typically also includes a seal so as to prevent fluid leakage, with the seal being readily openable by the ultimate consumer and readily resealable to thereby easily provide for storage of the container of liquid by the ultimate consumer.

To minimize cost, the various parts of the dispenser are increasingly made of plastic resins suitable for injection molding. Further, the designs have tended to be increasingly simplified and the number of separately molded parts minimized so that the assembly of the parts might be mechanized. A wide variety of hand-operated pumps exhibiting many of the aforementioned characteristics are to be found in the prior art, examples of which are disclosed in U.S. Pat. Nos. 2,792,969; 3,650,473; 3,685,739; 4,161,288; and 4,191,313.

The present invention is directed to a hand-operated pump which includes a nozzle for controlling the release of fluid from the pump, the nozzle including a centrally situated, forwardly facing, fixed protuberance. The fixed protuberance acts against the inside surface of an elastic, cup-shaped member which is secured at its periphery to the body. The cup-shaped member includes a central aperture situated in contact with the fixed protuberance such that, in its normal unstretched position, the central aperture is closed by the protuberance. This feature has the advangtage of assuring a good mechanical seal at the outlet of the hand-operated pump with a minimum number of moving parts. No clogging or sticking in an open position is expected with a wide variety of liquids. The central aperture of the cup-shaped member leads to a swirl chamber which functions in a conventional manner to cause the liquid to be sprayed when a cap which is adjustably connected to the body of the sprayer is appropriately positioned. With the cap situated in yet other positions, the liquid can be dispensed in the form of a stream or can be prevented from being dispensed entirely.

The invention also includes a trigger, pivotally connected to the body, which includes on a back surface a concave seat which receives an outwardly projecting nose of a piston protruding from a pumping cylinder of the sprayer. The concave seat is configured such that the nose of the piston is self-centering with respect to the trigger during the entire stroke within the cylinder. The cylinder itself includes a vent aperture leading to the container to which the pump is connected. The vent aperture is covered by an integral flange of the piston when the piston is in extreme outward position, the integral flange on the piston projecting toward the open end of the pumping cylinder, thereby preventing leakage from the container should the container be accidentally upset. A separate closed end facing flange acts to seal the pumping cylinder against the liquid to be dispensed.

The invention also includes a forwardly directed outlet conduit between the nozzle and the pumping cylinder. Side walls spaced laterally from the conduit and extending rearwardly from the nozzle area define the outer perimeter of the dispensing pump. An upper edge of the side wall defines an opening into which a top is received, the top having a peripheral flange situated inside the upper edge of the side wall. A pair of longitudinal tabs depend from the top to straddle the outlet conduit. A locking means is provided for mechanically snap-locking the top to the outlet conduit. This eliminates any need for adhesives, sonic welds, or the like to secure the top to the body portion of the dispensing pump.

Additional features and advantages of the present invention will become apparent to those skilled in the art upon consideration of the following discussion and the accompanying figures illustrating the preferred embodiment of the invention, the same being the best mode for carrying out the invention as perceived by the inventor. In the figures.

Figures 1, 2, 3, 4:
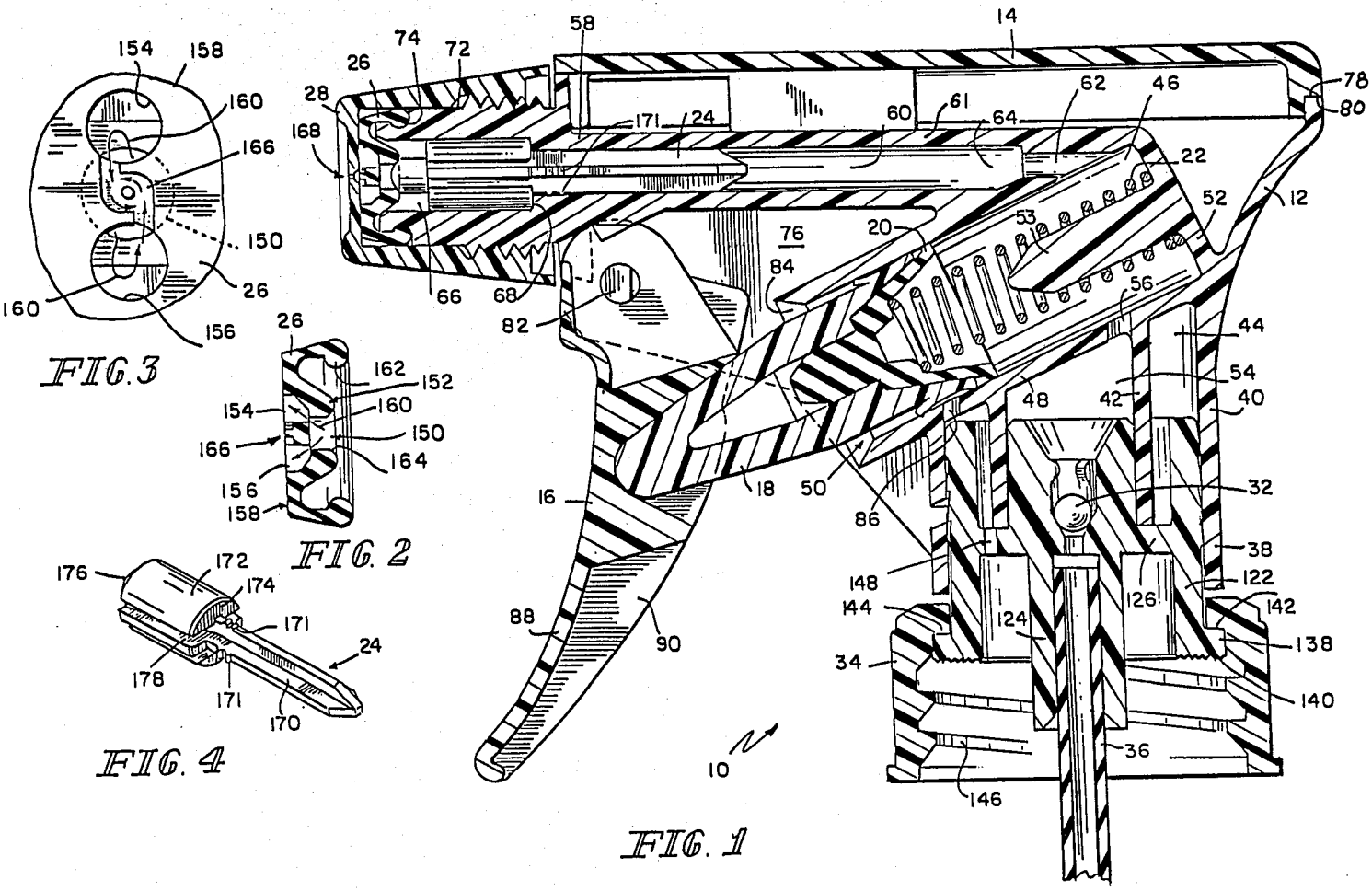
FIG. 1 is a sectional detail view of a hand-operated pump in accordance with the present invention.
FIG. 2 is a sectional detail of the flexible nozzle cup shown enlarged from FIG. 1.
FIG. 3 is a partial plan view of the flexible nozzle cup as viewed from the left side of and enlarged from FIG. 2.
FIG. 4 is a perspective view of a channel-defining insert received in the outlet chamber of the pump.

As shown in detail in the accompanying figures, the pump 10 comprises a body 12 having a separately molded top 14 fixed to the body 12. A trigger 16 is pivotally attached to the body and operates on piston 18 having liner 20 against the outward bias provided by spring 22. The body 12 receives a channel-defining insert 24 which cooperates with an elastic cup member 26 and nozzle cap 28 to control the output of the pump. A stem insert 30 which includes a ball 32 is received within the body and acts to retain the pump in position on a fluid container (not illustrated) by means of securing ring 34, the feed tube 36 extending downwardly toward the bottom of the fluid container.

The body 12 includes a stem portion 38 which consists of an outer cylindrical wall or skirt 40 and an inner cylindrical wall 42 which define therebetween a sleeve space 44 for receiving the stem insert 30. The body 12 also includes a pumping cylinder 46 defined by cylindrical wall 48, the pumping cylinder having an opened end 50 and a closed end 52. An inlet chamber 54 is defined by the inner cylindrical wall 42 of the stem portion 38 and the outer surface of cylindrical wall 48. The inlet chamber 54 is connected to the pumping cylinder 46 near the closed end 52 thereof by means of inlet opening 56.

A forwardly projecting portion 58 of the pump 10 includes a generally cylndrical outlet chamber 60 within conduit 61 which is connected to the pumping cylinder 46 by means of outlet opening 62. The longitudinal cylindrical outlet chamber 60 further includes an inner portion 64 which is separated from an outer portion 66 of larger diameter by a step 68. An outer surface 70 of the forwardly projecting portion 58 includes an appropriate thread structure 72 for cooperating with threads on cap 28. The forwardly projecting portion 58 also includes a ring-like depression 74 for receiving the outer periphery of the elastic cup member 26.

Figure 8:
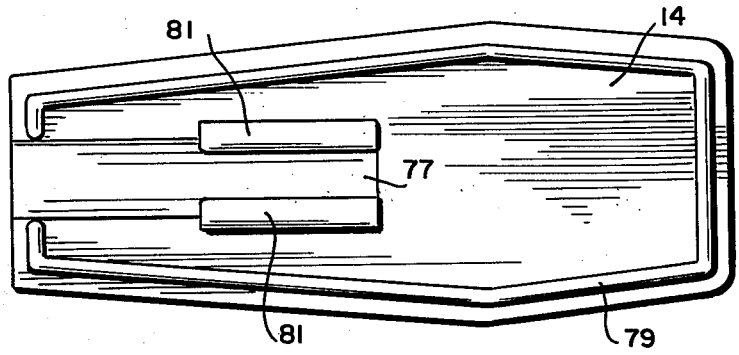
FIG. 8 is a bottom plan view of a top showing the pair of straddling locking tabs.

The body 12 includes a longitudinal web or side wall 76 extending down each side of the body from the forwardly projecting portion 58 to the stem portion 38 and across the back of body 12. The web 76 terminates in an upper edge 78 which mates with a lower edge 80 of top 14. The top 14 includes a peripheral flange 79 shown in FIG. 8 which extends substantially completely around the perimeter of the top, the flange 79 being received inside the upper edge 78 of web 76. As shown best in FIGS. 1, 8, and 9, flange 79 provides guide means for properly positioning the top 14 in relation to the underlying pump body 12. A pair of longitudinally extending tabs 81 depend from a central portion 77 of top 14 to straddle the outlet conduit 61.

Figure 9:
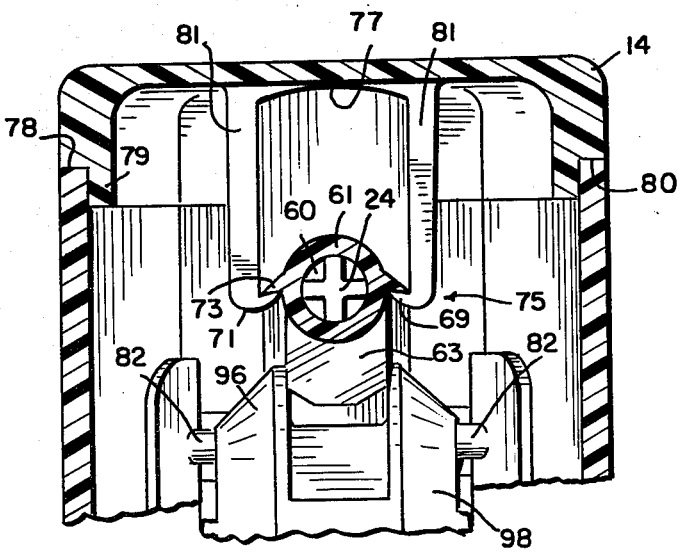
FIG. 9 is a sectional view taken along line 9—9 of FIG. 7.

A locking means 75 is provided for locking the top 14 to the body 12. The locking means 75 includes a longitudinally extending flange 73 on each side of outlet conduit 61. A flange-engaging means 71 on each of the tabs 81 engages the adjacent lateral flange 73. The flange-engaging means is shown in FIG. 9 to be a longitudinally extending, inwardly and upwardly projecting hook portion 69. The hook portion 69 is preferably wider than the lateral flange 73, the flange-engaging means 71 being spaced such that the inner surface of the hook portion 69 contacts the sides of the outlet conduit 61.

Figure 5:
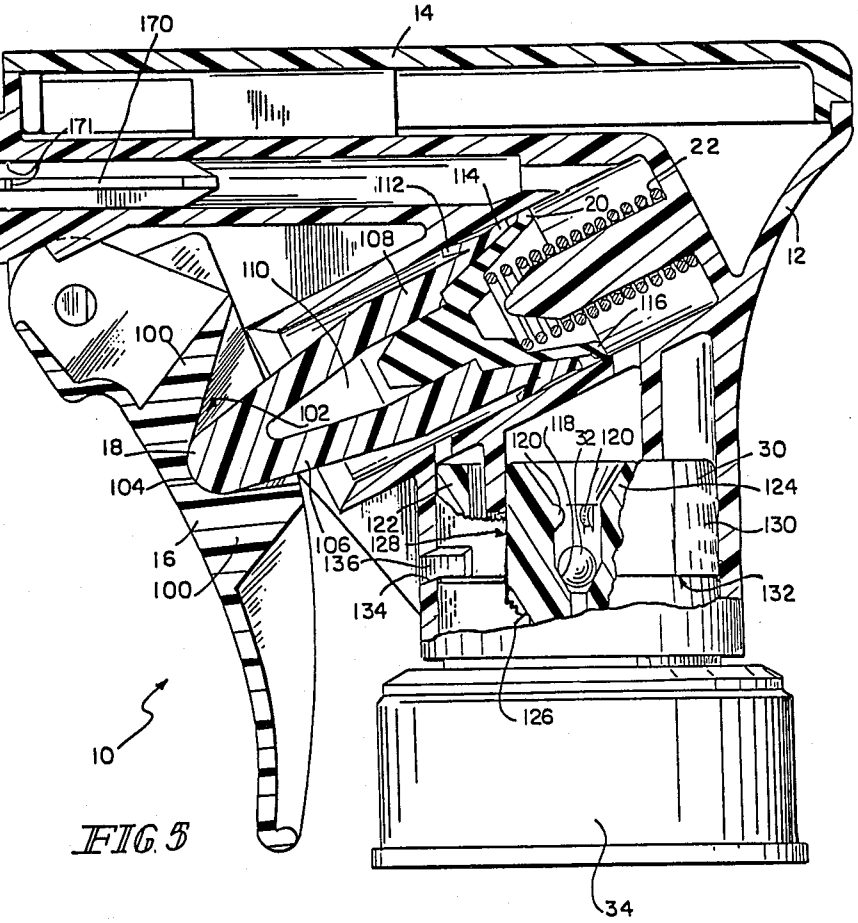
FIG. 5 is a sectional view of the invention similar to FIG. 1, with the cap displaced to the spray position and the trigger actuated to the compressed position.

The opened end 50 of the pumping cylinder 46 includes an outwardly tapered flange 84 shown in FIGS. 1 and 5 which permits ease in assembly of the piston 18, liner 20, and spring 22 within the pumping cylinder 46. The assembly is additionally simplified by the presence of an integral spring centering protrusion 53 on closed end 52 of the pumping cylinder 46. The protrusion 53 acts to center the spring 22 within the cylinder 46, thereby preventing the spring 22 from contacting and possibly damaging a sealing flange on the piston or liner. Near the opened end 50 of pumping cylinder 46 is vent aperture 86 which leads from the pumping cylinder 46 to the sleeve space 44.

Figure 6:
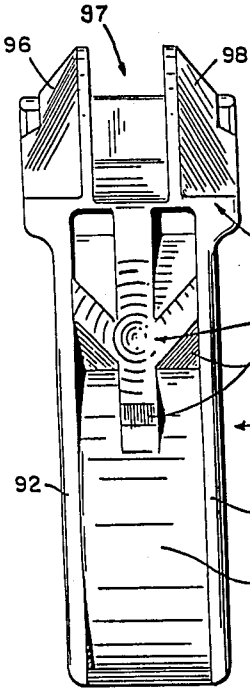
FIG. 6 is a back elevation view of the trigger showing the concave piston-receiving seat.
Figure 7:
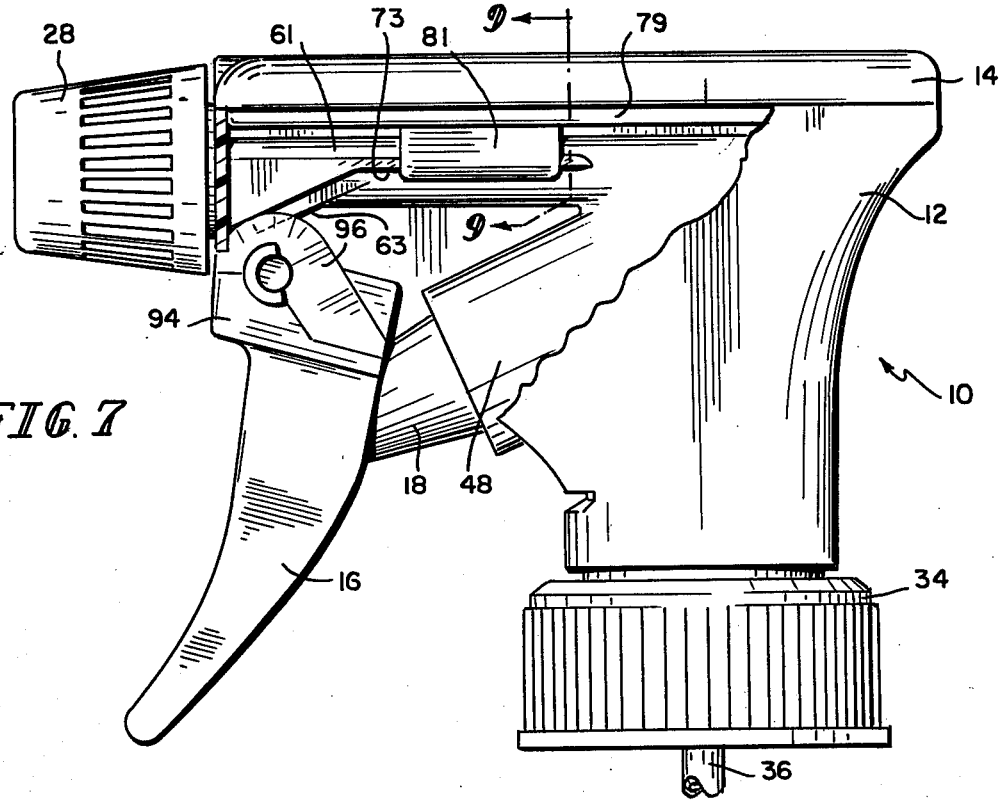
FIG. 7 is a side elevation view partially in section of the invention shown in FIG. 1.

The trigger 16 includes a web 88 defining a forward surface of the trigger 16 and two rearwardly projecting flanges 90 and 92 on opposite sides of web 88. The upper portion 94 of trigger 16 includes upwardly and rearwardly inclined surfaces 96 and 98 which permit the trigger 16 to be engaged on pivot stems 82 through a temporary plastic deflection of longitudinal webs 76 of the body. The longitudinal web 76 integrally includes inwardly projecting pivot stems 82 on which trigger 16 is pivotally engaged as shown in FIG. 9. A trigger locking means 63 is received in space 97 between the surfaces 96 and 98 to ensure locking engagement of the trigger 16 to body 12. On the rear side of the trigger 16 between flanges 90 and 92 and supported on web 88 are four generally triangular supports 100, as shown in FIG. 6, the bases of which come together to form a concave tapered socket 102 for receiving the outer end surface of piston 18.

Piston 18 includes a nose 104 which is snugly received in the socket 102 defined by the supports 100 on the rear surface of web 88 of trigger 16. The piston 18 extends rearwardly from the nose 104 with a tapered conical portion 106 leading to a cylindrical portion 108. A central opening 110 is provided in the piston 18, the central opening 110 receiving liner 20. At the end opposite the nose 104 of piston 18 are a pair of integral flanges 112 and 114. Flange 112 is forwardly directed toward the open end of the pumping chamber 46, while flange 114 is rearwardly directed toward the closed end of pumping cylinder 46.

When the piston 18 and trigger 16 are situated in a relaxed position as shown in FIG. 1, the flanges 112 and 114 lie on opposite sides of vent aperture 86. As the trigger 16 of pump 10 is actuated rearwardly as shown in FIG. 5, the forward-facing flange 112 moves toward the closed end 52 of pumping cylinder 46, thereby opening vent aperture 86 to the atmosphere through the opened end 50 of the pumping cylinder. As the trigger 16 is then released from the position shown in FIG. 5, the restoring force of spring 22 displaces the piston and trigger back toward the position shown in FIG. 1, and flange 112 again seals vent aperture 86 so as to prevent accidental spillage of the contents of the container to which the pump is connected.

The liner 20, which is optional, includes a second rearwardly facing flange 116 which acts to ensure the fluid seal of the pumping chamber 46 at all times. As the trigger moves from the position shown in FIG. 1 to the position shown in FIG. 5, the pumping cylinder 46 comes under a compressive force due to the rearward movement of liner 20 and piston 18. Any liquid present in the cylinder 46 is prevented from moving downward into feed tube 36 by virtue of the presence of the ball 32 cooperating with a conically tapered sealing surface 118 on the interior of stem insert 30 which, together with ball 32, forms a lower check valve for the pump mechanism 10.

The stem insert 30 also includes a plurality of protuberances 120 immediately above ball 32 which prevent the ball from escaping from the check valve configuration illustrated in FIGS. 1 and 5. The stem insert 30 includes an outer cylindrical wall 122 and an inner cylindrical wall 124 integrally joined by a ring-shaped web 126. The conically tapered sealing surface 118 and protuberances 120 can be seen to exist on selected portions of the interior surface of the inner cylindrical wall. Below the check valve which is formed by ball 32 and tapered sealing surface 118 is the feed tube 36 which is snugly received on the inner surface of the lower portion of the inner cylindrical wall 124. The outer portion 128 of the upper portion of the inner cylindrical wall 124 is snugly received within the inner cylindrial wall 42 of the stem portion 38 of body 12 to form a fluid-tight seal defining the lower portion of inlet chamber 54.

The outer surface 130 of the outer cylindrical wall 122 includes at least one downwardly directed ridge 132. The ridge 132 is intended to engage a lower surface 134 of locking aperture 136 which is located in the front portion of stem 38 of body 12. The locking aperture 136 shown best in FIG. 5 comprises a generally horizontal slot, the lower surface 134 of which is slightly angularly inclined so as to lockingly engage with a downwardly projecting ridge 132 on stem insert 30. A ring 135 contiguous with lower surface 134 of aperture 136 extends around the inner surface fo skirt 40 to provide additional locking engagement with ridge 132 of insert 30.

A lower end of the stem insert 30 includes an outwardly projecting flange 138. On the lower surface of flange 138 are ridges 140 intended to ensure good sealing characteristics between the stem insert 30 and the upper surface of the finish of any container to which the pump 10 is secured. The upper surface 142 of flange 138 of stem 30 engages an inwardly projecting ring portion 144 of securing ring 34. While in FIG. 1 the interior surface of securing ring 34 is shown to include screw threads 146, other finish-engaging features other than screw threads 146 can be employed.

The ring-like web 126 joining the outer cylindrical wall 122 and inner cylindrical wall 124 of stem insert 30 includes aperture 148 which leads from sleeve space 44 in the stem portion 38 of body 12 down into the head space above the liquid contained in the holder to which the pump is applied. The opening 148, together with the opening 86, provides a clear vent passage for the entry of air from the atmosphere into the container simultaneously with the movement of liquid from the container through inlet chamber 54 into the pumping cylinder 46. As the trigger 16 is released from the position shown in FIG. 5 to return to the position shown in FIG. 1, the seals 112, 114, and 116 prevent any air from entering pumping chamber 46. The resulting enlargement in size of pumping chamber 46 causes liquid to enter the feed tube 36 and move upward past ball 32 through the inlet chamber 54 and inlet opening 56 into the pumping chamber 46.

The nozzle assembly which includes the insert 24, the cup member 26, and cap 28 are shown in FIG. 1 in a closed position. That is, the cap 28 is positioned so as to hold cup member 26 in fixed location such that a rear surface of the cup 26 seals against the forward protuberance of insert 24. The elastic cup member 26 shown in greater detail in FIGS. 2 and 3 comprises a central rearwardly facing aperture 150, which aperture is a circular cavity in the center of the interior surface 152 of cup member 26. The central aperture 150 extends only partway through member 26. A pair of depressions 154 and 156 on the front or exterior surface 158 intersect with the central rear-facing aperture 150 to form pathways 160 for fluid exiting the pump as shown in FIGS. 2, 3, and 5. The cup 26 includes a ring-shaped lip 162 which cooperatively engages in depression 74 of the forwardly projecting portion 58 of the body 12 of the pump. The cup member 26 is dimensioned such that, in the absence of any significant fluid pressure, the edge 164 of central aperture 150 contacts and seals against the forwardly protruding nose of insert 24.

When the cap 28 is moved from the position shown in FIG. 1 to the position shown in FIG. 5, there is a small space which occurs between cap 28 and the exterior surface 158 of cup member 26. As the fluid pressure in the pump increases with the action of the trigger and piston mechanism, the elastic cup 26 deforms slightly and stretches due to its inherent elasticity sufficiently to cause pathways 160 to occur, at which time the fluid may pass by insert 24 into central aperture 150 and from there into forward-facing depressions 154 and 156. With the cap 28 positioned as shown in FIG. 5, the elastic stretching of cup 26 is sufficient to again cause the front surface 158 of cup 26 to contact the interior of cap 28. This causes the exiting fluid to behave as illustrated in FIG. 3. That is, the cap 26 includes a shallow swirl chamber 166 on the front surface 158 between and connected to depressions 154 and 156. The fluid following pathways 160 as illustrated in FIG. 3 gains an angular momentum component due to the swirl chamber 166 and exits through the central orifice 168 of cap 28 in the form of a spray.

If cap 28 is further moved an additional distance to the position shown in phantom in FIG. 5, then liquid following pathways 160 is not confined to the swirl chamber 166, and hence no significant angular momentum component is achieved and the liquid exits through opening 168 in the form of a stream.

The insert 24 shown in more detail in FIG. 4 includes a smaller diameter section 170 and a larger diameter section 172 joined by a shoulder 174. The outer dimensions of the smaller diameter portion 170 are intended to guide the insert 24 into the inner portion 64 of chamber 60 to be snugly secured therein by securing ribs 171. The rearward-facing shoulder 174 is caused to firmly abut step 68 which separates the inner portion 64 of the outlet chamber 60 from the outer portion 66. This causes the nose 176 of insert 24 to be reliably positioned within the outer portion 66 of the outlet chamber 60 so as to cooperate with the edge 164 of the central opening 150 of cup 26 as previously described.

A plurality of tapered channels 178 are provided along the edge of insert 24 to permit the fluid to pass from the inner portion 64 to the outer portion 66 of the outlet chamber 60. The surface 176 of insert 24 is centrally situated in the outer portion 66 of the outlet chamber 60 and acts as a fixed protuberance against which the elastic cup-shaped member 26 rests when not subjected to fluid pressures. In this manner, the forward protuberance 176 and the lip 164 of central opening 150 act as an upper check valve for the pumping action such that when the trigger 16 is moved from the position shown in FIG. 5 to the position shown in FIG. 1, air is prevented from entering the outlet chamber 60 through the nozzle.

The cup 26 may be viewed as a single element moving check member having a spray-defining swirl chamber on an outer surface, the cup 26 being biased toward its sealed position by virtue of its inherent elasticity and memory. While a variety of materials might be employed which have sufficient elastic memory characteristics to perform the intended function of cup member 26, a preferred material is a low-density polyethylene such as ALATHON 20.

The foregoing description of the preferred embodiment of the invention is intended to be merely illustrative and certain variations and modifications may be apparent to those skilled in the art without departing from the spirit and scope of the present invention as defined in the following claims.

What is claimed is:

1. A dispensing apparatus comprising a body portion including a variable volume pump chamber, a forwardly directed outlet conduit from the pump chamber, and a peripheral side wall spaced laterally from the outlet conduit having an upper edge defining a top opening, a top having a depending peripheral flange situated inside the upper edge defining the top opening and a pair of longitudinally extending tabs depending from the top to straddle the outlet conduit, and locking means for locking the top to the body portion, the locking means including a longitudinally extending lateral flange on each side of the outlet conduit and engaging means on the pair of longitudinally extending tabs for engaging the lateral flanges.

2. The dispensing apparatus of claim 1 wherein the engaging means comprises a longitudinally extending, inwardly and upwardly projecting hook portion situated under each horizontally extending lateral flange of the outlet conduit.

3. The dispensing apparatus of claim 2 wherein the inwardly projecting hook portion of the engaging means is larger than the lateral flange portion of the outlet conduit, and the lower ends of the tabs are spaced such that the inner surface of the hook portion continuously contacts the sides of the outlet conduit.

4. A dispensing apparatus comprising a body portion containing a variable volume pump chamber, a pair of sides extending forwardly from the pump chamber, and a pair of opposing inwardly directed pivot stems fixed to the sides, a trigger mounted with respect to the body and contacting the chamber to vary the volume thereof, the trigger including a pair of spaced-apart, oppositely upwardly and rearwardly inclined surfaces for allowing the trigger to be engaged on the pivot stems through a temporary plastic deflection of the body sides, and a trigger locking means received in the space between the inclined surfaces for locking the trigger in pivotal engagement on the body.

5. A dispensing apparatus comprising a body portion including a variable volume pump chamber, a forwardly directed outlet conduit from the pump chamber, and a peripheral side wall spaced laterally from the outlet conduit having an upper edge defining a top opening, a top having a pair of longitudinally extending tabs depending from the top to straddle the outlet conduit, locking means for locking the top to the body portion, the locking means including a longitudinally extending lateral flange on each side of the outlet conduit and engaging means on the pair of longitudinally extending tabs for engaging the lateral flanges.

6. A dispensing apparatus comprising a body portion including a variable volume pump chamber, a forwardly directed outlet conduit from the pump chamber, and a peripheral side wall spaced laterally from the outlet conduit having an upper edge defining a top opening, a top having a pair of longitudinally extending tabs depending from the top to straddle the outlet conduit, means for positioning the top in relation to the top opening of the body portion, and locking means for locking the top to the body portion, the locking means including a longitudinally extending lateral flange on each side of the outlet conduit and engaging means on the pair of longitudinally extending tabs for engaging the lateral flanges.

* * * * *